US006913256B2

(12) United States Patent
Dornbusch

(10) Patent No.: US 6,913,256 B2
(45) Date of Patent: Jul. 5, 2005

(54) FORMER FOR A FOLDING UNIT

(75) Inventor: Gerold Emil Dornbusch, Triefenstein (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/485,111

(22) PCT Filed: Jul. 19, 2002

(86) PCT No.: PCT/DE02/02660

§ 371 (c)(1),
(2), (4) Date: Feb. 3, 2004

(87) PCT Pub. No.: WO03/016189

PCT Pub. Date: Feb. 27, 2003

(65) Prior Publication Data

US 2004/0188909 A1 Sep. 30, 2004

(30) Foreign Application Priority Data

Aug. 9, 2001 (DE) ..... 101 39 216

(51) Int. Cl.[7] ..... B41F 13/58

(52) U.S. Cl. ..... 270/5.02; 226/122; 226/137; 493/357; 493/359; 493/360; 493/442

(58) Field of Search ..... 270/4, 5.01, 6, 270/5.02, 20.1, 21.1; 226/122, 137; 493/356, 357, 359, 360, 435, 442

(56) References Cited

U.S. PATENT DOCUMENTS

| | | | | | |
|---|---|---|---|---|---|
| 4,562,947 | A | * | 1/1986 | Bishop et al. | 226/121 |
| 5,449,156 | A | | 9/1995 | Gnuechtel et al. | |
| 5,605,267 | A | * | 2/1997 | Whitten | 226/91 |
| 5,716,311 | A | | 2/1998 | Novick et al. | |
| 6,497,643 | B1 | * | 12/2002 | Hartmann et al. | 493/458 |

FOREIGN PATENT DOCUMENTS

| | | | |
|---|---|---|---|
| DE | 41 37 818 | A1 | 5/1993 |
| DE | 44 28 593 | A1 | 5/1995 |
| DE | 297 23 888 | U1 | 7/1999 |
| JP | 10-329094 | A * | 12/1998 |

* cited by examiner

*Primary Examiner*—Eugene H. Eickholt
(74) *Attorney, Agent, or Firm*—Jones Tullar & Cooper PC

(57) ABSTRACT

A former roller, which is driven for rotation, is located at the intake of a former for a folding unit. A controller unit is utilized to control the rotation of the motor, which drives the former roller, in such a way that the former roller exerts a tensile force on a material web that is fed to the former roller.

21 Claims, 2 Drawing Sheets

FORMER FOR A FOLDING UNIT

FIELD OF THE INVENTION

The present invention is directed to a method and devices for folding with a former.

BACKGROUND OF THE INVENTION

Customarily, a former is provided with a former roller, by use of which a web of material, brought in to the former from a side, is rerouted downwardly into the former. The former roller is driven by a motor at a regulated speed for avoiding imposing a tensile load on the web of material. The roller rotates with a circumferential speed matched to the conveying speed of the web and avoids the exertion of a tensile load on the web.

Errors can occur in the course of processing the web of material in the folding apparatus with the result being that a considerable amount of material is conveyed into the folding apparatus, which material can no longer be correctly processed in the folding apparatus and which material thus piles up before the folding apparatus, and a device which is located upstream of it, such as, for example a printing press from which the material is supplied, can be brought to a stop. Such a pile-up of material can result in damage to the folding apparatus. To limit the amount of material which can pile up at one location, it is generally known to provide cut-off devices along the conveying path of the material, which devices cut off the web of material in the event of a malfunction. If the leading end of the web of material, which leading end is being created in the course of the cut-off, is successfully moved out of the conveying path, this results in a limitation of the amount of material which can pile up in the folding apparatus, and the danger of damage is thereby reduced. On the other hand, because of the cut-off, the tension in the web of material, which tension is present during normal operations, collapses, so that pile-ups of material can result at other locations, in particular in a device upstream of the folding apparatus, such as a printing press.

DE 44 28 593 A1 describes a device for measuring and regulating the tension in a web in a former area. In the course of the use of this device, the force of the web acting on the former is detected and the former roller is controlled as a function of this force.

DE 41 37 818 A1 discloses a device for setting the web tension. A number of revolutions of traction rollers arranged downstream of a former can be mutually regulated.

DE 297 23 888 U 1 discloses a linear former with a driven former inlet roller.

A device for folding webs of material is known from U.S. Pat. No. 5,449,156. A web tension is changed by changing the number of revolutions of a traction roller.

SUMMARY OF THE INVENTION

The object of the present invention is based on providing a former for a folding apparatus.

In accordance with the present invention, this object is attained by providing a former with a former roller at the entrance to the former. The former roller is driven by a motor. In the event of the detection of an error, the web of material being directed to the former is cut. The former roller continues to rotate after the web of material has been cut. The former roller is driven by its drive motor at a web tension level which is less than half of the web tension level which exists during error free operation.

The advantages which can be gained by the invention consist, in particular, in that because of the manner in which the motor rotation is regulated, it is possible to avoid the complete collapse or elimination of the tension in the web of material prior to the web's entry into the folding apparatus if the web of material is cut off in the folding apparatus because of the appearance of a malfunction. In the course of braking the folding apparatus and a device located upstream of it, material continues to be conveyed out of the upstream-located device, and a pile-up of material in the upstream-located device, which would possibly be difficult to clear up or which could result in damage to the upstream-located device, is prevented. In such a case, the material of the web can collect to a considerable extent in the former without leading to damage. The collected material can be removed from the former with little effort.

The regulating device for the former is preferably provided with a sensor for use in detecting a traction force exerted by the former roller on the web of material. The regulating device regulates the rotation of the motor in such a way that this traction force is maintained substantially constant. Such a sensor can detect, for example, a force exerted on a bearing of the former roller or a force exerted on another roller rerouting the web of material. The sensor can be formed by an array of sensors for use in measuring the conveying speed of the web of material and the power consumption of the motor, from which measured values conclusions can be drawn regarding the force exerted by the former roller on the web of material.

In accordance with an alternative embodiment of the present invention, the regulating unit can contain a sensor for use in detecting a conveying speed of the web of material. The regulating unit then regulates the rotation of the motor in such a way that the former roller maintains a substantially constant lead over the web of material.

To assure that, in the case of a tear in the web of material, or a cut-off of the web of material, the traction force of the former roller continues to act on the web of material, at least one roller for use in pressing the web of material against the former roller is suitably provided.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
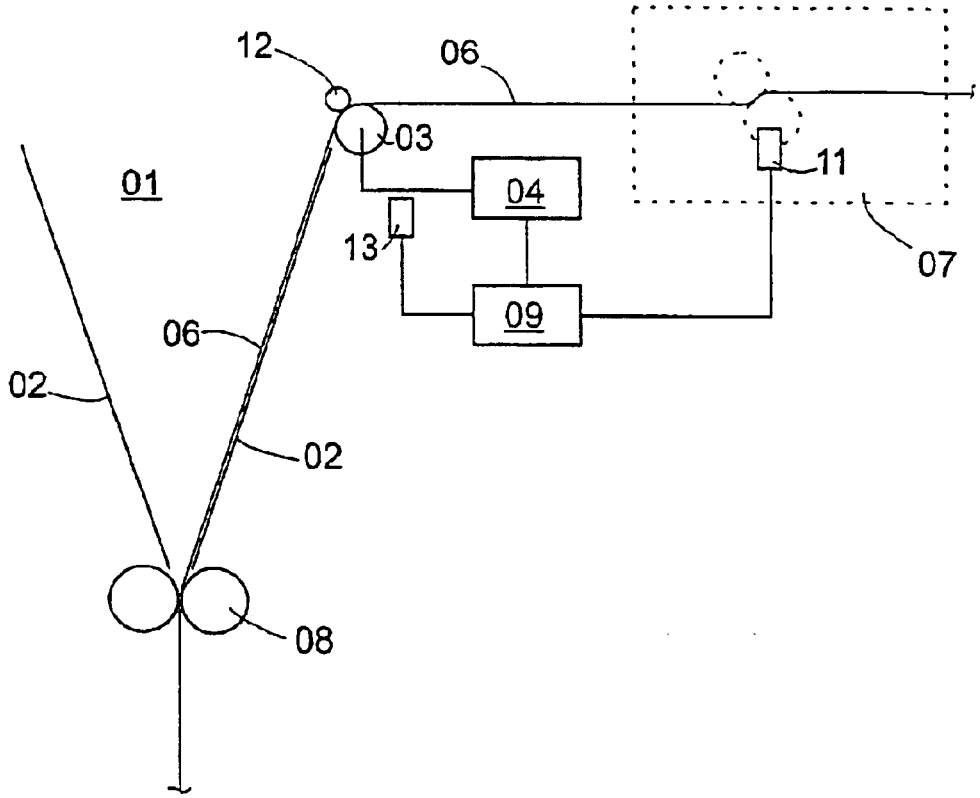
FIG. 1, a schematic representation of a former in accordance with a first preferred embodiment of the present invention, in FIG. 2, a schematic representation of a second preferred embodiment of the former, and in FIG. 3, the former after a web of material has been torn or cut off in the folding apparatus.

A schematic section through a former 01 of a folding apparatus, in accordance with a first preferred embodiment of the present invention, is represented in FIG. 1. The former 01 is substantially constructed of two lateral walls 02, which extend downward toward each other. A former roller 03, or a former inlet roller, is mounted, rotatingly driven by a motor 04, on the upper edge of one of the lateral walls 02 and is used for rerouting a web of material 06, which is conveyed to the former roller 03 in the horizontal direction from a web-fed printing press 07, represented as a dashed rectangle, into the former 01. The former roller 03 is embodied as a former inlet roller 03, which is arranged directly at the former inlet and which is driven at a web tension which is less than one-half of the web tension during error-free folding.

The web of material 06 is conveyed between two folding rollers 08, which are arranged at the bottom of the former 01, to a transverse folding device which is not specifically represented, which transverse folding device separates the web of material 06 into separate sheets, which separate sheets subsequently are to be transversely folded.

The web of material 06 is maintained pressed against the former roller 03 by a presser roller 12. The presser roller 12 can have the shape of a cylinder that is substantially extending over the length of the former roller 03 and that is parallel with it. Alternatively, the presser roller 12 can be constituted by one or by several wheel disks of lesser width which are mounted on a common shaft.

Two sensors 11, 13 are connected to a regulating unit 09, as seen in FIG. 1. The sensor 11 is used for detecting a conveying speed of the web of material 06. The sensor 13 is used for detecting the rotary speed of the motor 04. The sensor 11 can be arranged, for example, on the plate cylinder of the web-fed printing press 07 in order to detect the rotational speed or the circumferential speed of the plate cylinder. The sensor 13 is arranged on the driveshaft of the former roller 03. The sensor 13 detects a traction force exerted by the former roller 03 on the web of material, for example, and a conveying speed of the web of material 06. With this configuration it is the object of the regulating unit 09 to regulate the rotating speed of the former roller 03 in such a way that as constant as possible a lead exists between the former roller 03 and the web of material 06 rerouted at it. The former roller 03 thus has an "advance" with respect to the web of material which should be maintained constantly and which should keep the web of material 06 under tension prior to the web of material 06 reaching the former roller 03. The result of this tension is that the former roller 03 has a slightly greater rotational speed than the linear speed of the web of material 06 running off on it. The difference between the two speeds is a function of the size of the lead, or of the traction force exerted by the former roller 03 on the web of material 06. To maintain the lead constant, the regulating unit 09 therefore regulates the operation of the motor 04 in such a way that the circumferential speed of the former roller 03 is greater, by a preset small differential amount, than the linear speed, detected by the sensor 11, of the web of material 06 itself.

Figure 2:
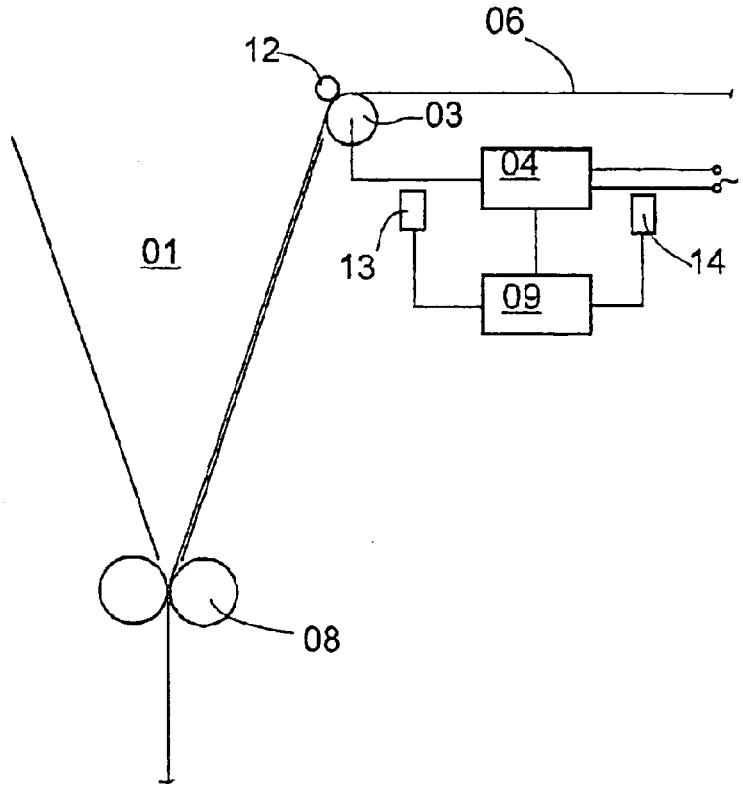

In a second preferred embodiment of the present invention, as shown in FIG. 2, the sensor 11 for detecting the speed of the web of material 06 is replaced by a sensor 14 which measures, for example, the strength of an electrical current supply of the motor 04. Based on this electrical current strength, and on a known supply voltage of the motor 04, the regulating unit 09 can draw conclusions regarding the output of the motor 04 in this second preferred embodiment. By employing the speed of the former roller 03, detected by the sensor 14, the regulating unit 09 can draw conclusions regarding the force which the roller exerts on the web of material 06. Thus, the regulating unit 09 can regulate the operation of the motor 04 in such a way that, during normal operations, the traction force exerted by the former roller 03 on the web of material 06 remains substantially constant.

In this way, it is assured by application of both of the two preferred embodiments, that the web of material 06 is under a substantially constant tension between the outlet of the web-fed printing press 07 and the former roller 03.

Figure 3:
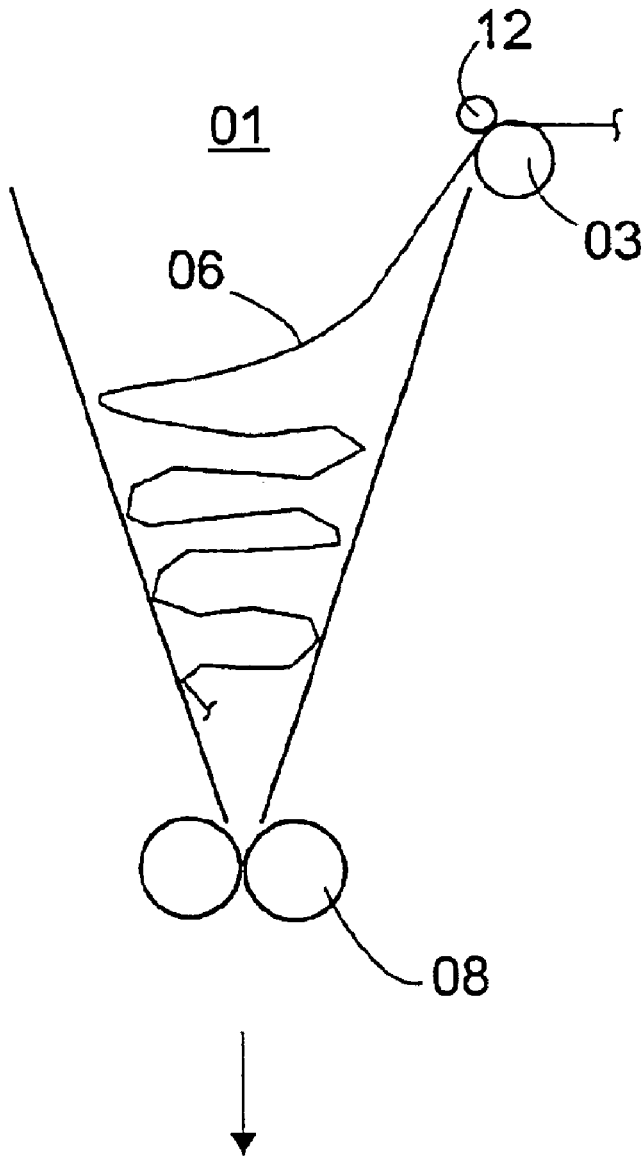

If a malfunction occurs in the folding apparatus so that the web of material 06 can no longer be properly processed, it is necessary to bring the folding apparatus and the web-fed printing press to a stop as rapidly as possible in order to prevent the material of the web of material 06, which can no longer be processed, from piling up at an undesirable location, and from possibly being wound around a roller of the web-fed printing press 07 or of the folding apparatus and resulting in damage to the press 07 or to the folding apparatus. By way of example, it is first to be assumed that the malfunction is in the form of a tear of the web of material, which material web tear results in the tension of the web of material 06, at the location of the former 01, collapsing. The web of material 06 is no longer pulled out of the bottom of the former 01. Since, in the case of the first preferred embodiment of the invention in accordance with FIG. 1, the former roller 03, which is coupled with the rotation of the plate cylinder of the web-fed printing press 07, continues to run until the web-fed printing press 07 has come to a complete stop, the web of material 06 continues to be pulled off the output of the web-fed printing press 07 by the former roller 03 and is therefore prevented from piling up, or accumulating, at an inaccessible location in the web-fed printing press 07 and thus from possibly causing damage there. The material is instead collected in the former 01, as is depicted schematically in FIG. 3, from which collection area it can be easily removed after the web-fed printing pres 07 and the folding apparatus have come to a stop.

In the case of the second preferred embodiment of the invention in accordance with FIG. 2, in case of a malfunction, the former roller 03 is initially rotated, until the regulating unit 09 notices, on the basis of the result of the determination by the sensor 13 that the former roller 03 is stopped, because the web of material 06 is tightly stretched between the output of the stopped web-fed printing press 07 and the former roller 03, or that the former roller 03 now rotates freely because the web of material 06 is interrupted between it and output of the web-fed printing press 07. In these two cases the regulating unit 09 then switches the motor 04 off. The result in this second embodiment is also that web material is collected in the former 01, from which it can be easily removed afterwards.

If a malfunction is detected in the folding apparatus or in the web-fed printing press 07, the web of material 06 is generally severed at one or at several locations by the operation of automatic cut-off devices, one of which is arranged in the inlet area of the folding apparatus in such a way that, when it cuts the web of material 06, the tension of the latter collapses in the area of the former 01. The result is the same as in the above considered case of the tear in the web of material. The portion of the web of material 06, which is located downstream in the conveying direction from the cut location, is no longer drawn out of the former 01, and web material is collected in the former 01 until the web-fed printing press 07 has come to a stop. The former roller 03 continues to rotate, for example until the stop of cylinders of a folding apparatus or the stop of cylinders of the printing groups. With the web tension collapsed, the former roller 03 is driven in the area of the former.

While preferred embodiments of a method and devices for folding with a former, in accordance with the present invention, have been set forth fully and completely hereinabove, it will be apparent to one of skill in the art that various changes in, for example, the structure of the web-fed printing press, the type of material web being conveyed, and the like could be made without departing from the true spirit and scope of the present invention, which is accordingly to be limited only by the appended claims.

What is claimed is:

1. A method for folding a web including:

providing a web former having a former entrance;

locating a former roller at said entrance;

providing a drive motor for said former roller and using said drive motor for rotating said former roller;

detecting a malfunction in a printing process utilizing the web;

cutting the web after detecting the malfunction; and continuing rotating said former roller after cutting the web of material.

2. The method of claim 1 further including using said former roller for conveying the web and exerting a traction force on the web being conveyed by said former roller.

3. The method of claim 1 further including providing a sensor and using said sensor for detecting a traction force exerted on said web by said former roller.

4. The method of claim 1 further including providing a folding apparatus including rotatable folding cylinders and continuing rotating said former roller until said folding cylinders stop rotating.

5. The method of claim 1 further including providing printing groups having rotatable cylinders and continuing rotating said former roller until said printing group cylinders stop rotating.

6. The method of claim 1 further including providing said former roller as a former inlet roller and locating said former inlet roller at a former inlet.

7. The method of claim 1 further including driving said former roller at a web tension, said web tension being less than half of an error-free web tension.

8. The method of claim 1 further including providing a presser roller and using said presser roller for pressing the web against said former roller.

9. A device for folding a web comprising:

a web former having a former entrance;

a former roller arranged at said former entrance; and a motor adapted to rotatably drive said former roller, said former roller exerting a contact traction force on a web engaging said former roller and driven at a web tension, said web tension being less than half a web tension during an error-free operation of said device for folding.

10. The device of claim 9 further including a sensor adapted to detect said traction force exerted on said web by said former roller.

11. The device of claim 9 further including a folding apparatus including rotatable folding cylinders and wherein said former roller is driven for rotation until said folding cylinders stop rotation.

12. The device of claim 9 further including printing groups having rotatable cylinders and wherein said former roller is driven for rotation until said printing groups cylinders stop rotation.

13. The device of claim 9 further wherein said former entrance is a former inlet and said former roller is a former inlet roller.

14. The device of claim 9 further including a presser roller adapted to press the web against said former roller.

15. A device for folding a web comprising:

a web former having a former entrance;

a former roller arranged at said former entrance; and a motor adapted to rotatably drive said former roller, said motor driving said former roller at a conveying speed, said conveying speed having a substantially constant lead in comparison to a web conveyor speed.

16. The device of claim 15 further including a sensor for detecting said web conveying speed.

17. The device of claim 15 further including a folding apparatus including rotatable folding cylinders and wherein said former roller is driven for rotation until said folding cylinders stop rotation.

18. The device of claim 15 further including printing groups having rotatable cylinders and wherein said former roller is driven for rotation until said printing groups cylinders stop rotation.

19. The device of claim 9 further wherein said former entrance is a former inlet and said former roller is a former inlet roller.

20. The device of claim 15 wherein said former roller is driven at a web tension, said web tension being less than half of an error-free web tension.

21. The device of claim 15 further including a presser roller adapted to press the web against said former roller.

* * * * *